United States Patent [19]

Shouse

[11] Patent Number: 4,616,450

[45] Date of Patent: Oct. 14, 1986

[54] EAVES TROUGH/RAIN GUTTER SHIELD

[75] Inventor: George K. Shouse, 235 South Dr., Hampton, Ga. 30228

[73] Assignees: George K. Shouse; Joe B. Newsome, both of Hampton, Ga.

[21] Appl. No.: 708,499

[22] Filed: Mar. 5, 1985

[51] Int. Cl.[4] ..... E04D 13/00

[52] U.S. Cl. ..... 52/12

[58] Field of Search ..... 52/12, 11, 13, 14, 15, 52/16; 248/48.1; 210/474, 477

[56] References Cited

U.S. PATENT DOCUMENTS

| | | | |
|---|---|---|---|
| 2,636,458 | 4/1953 | Harris | 52/12 X |
| 3,950,951 | 4/1976 | Zukauskas | 52/12 X |
| 4,411,110 | 8/1983 | Carey | 52/12 X |
| 4,418,504 | 12/1983 | Lassiter | 52/12 |
| 4,435,925 | 3/1984 | Jefferys | 52/12 |

*Primary Examiner*—Carl D. Friedman
*Assistant Examiner*—Naoko N. Slack
*Attorney, Agent, or Firm*—Michael C. Smith

[57] ABSTRACT

Apparatus for preventing ingress of particulates into an eaves trough/rain gutter comprising a gutter shield having a solid upper surface and a side surface which has a first row of rain guidance apertures and a second row of rain receiving apertures inscribed therein wherein both of said surfaces are pre-weathered to a durable, uniformly wettable condition.

20 Claims, 6 Drawing Figures

EAVES TROUGH/RAIN GUTTER SHIELD

TECHNICAL FIELD

The present invention relates generally to roof rain gutter construction, specifically to an eaves trough/rain gutter shield, and more specifically to a rain gutter shield for preventing ingress of particulates such as pine straw into the rain gutter comprising a shield having a near horizontal solid upper surface and a substantially vertical side surface which has liquid guidance apertures and liquid receiving apertures inscribed therein, wherein both surfaces are pre-weathered to a wettable condition and continue to be wettable as the shield ages.

BACKGROUND ART

Rain gutter shields are well known in the art as means for preventing accumulation of particulates in the gutters and downspouts of a building. The simplest shield has been small mesh screen which covers the top of the gutter and prevents ingress of particulates larger than the mesh openings, but allows the rain to pass into the gutter. The primary disadvantage with screen shields has been that the screen tends to accumulate particulates, thereby obstructing water flow and resulting in yet another surface to be cleaned.

U.S. Pat. No. 891,405 shows an eaves trough having a rebent perforated strainer at its outer side to accept rain from its inclined top cover. U.S. Pat. No. 2,672,832 shows an eaves trough having a separately attached top cover which guides water to a lengthwise v-groove which directs water into the trough through a lenghtwise slot between the gutter and the cover. U.S. Pat. No. 3,080,682 discloses an eaves trough construction which has rain openings at the top, inner portion of the upper surface to receive rain directly from the roof. U.S. Pat. No. 3,388,555 shows an eaves trough with an outwardly convex top portion which has openings with inwardly and downwardly extending flanges for receiving water while straining out particles larger than the openings. U.S. Pat. No. 3,950,951 discloses a covered gutter having a corrugated top and a side portion which are separated by leaf deflectors comprising fins, coils and screens. U.S. Pat. No. 4,411,110 disclosed a rain gutter having a closed top and having a side with a plurality of inwardly and downwardly extending horizontal flaps for receiving flowing rain. U.S. Pat. No. 4,435,925 claims a gutter shield having a hydrophilic outer surface produced by proper base material and/or coating, a collector top, a curved nose having a radius of from 0.5 inch to 2.0 inches, and a re-entrant portion with teeth having spaces therebetween for entrance of rain. While these improvements over the simple screen are significant, the present invention provides a more effective gutter shield which can be readily used with a conventional rain gutter without excessive lowering of the gutter on the fascia board of the building.

DISCLOSURE OF INVENTION

The present invention is an eaves trough/rain gutter shield for preventing ingress of particulates such as pine straw into the rain gutter without reducing the fluid capacity of any portion of the gutter, comprising a near horizontal solid upper surface and a substantially vertical side surface which has liquid guidance apertures and liquid receiving apertures inscribed therein wherein both surfaces are pre-weathered, durably wettable and continue to be wettable as the shield ages. This shield is easily and quickly installed with conventional gutters without special tools, without field adjustment to match roof pitch or trough height and without excessive lowering of the gutter on the fascia board. In addition, the present shield is easily removable for maintenance, has an easily cleaned surface, resists damage by the use of ladders to climb to the roof, and is easily and compactly stacked for shipping and storage. The pre-weathered, wettable surfaces of this invention have no tendency to coalesce droplets or patches of water and remain uniformly wettable as the shield becomes weathered over time. The present shield prevents ingress of substantially all particulates whether falling from above, being blown by wind, or being washed from the roof by rain; and this gutter shield prevents gutter and downspout overflow during extremely heavy rainfall by valving excess rain away from the gutter.

Thus a primary object of the present invention is to provide a shield for an eaves trough/rain gutter which effectively directs rain into the gutter while excluding particulates.

Another object is to provide an effective gutter shield which does not reduce the fluid capacity of any portion of the gutter.

Another object of the present invention is to provide a gutter shield having a near horizontal solid upper surface and a substantially vertical side surface with liquid guidance apertures and liquid receiving apertures inscribed therein.

Still another object of this invention is to provide an effective gutter shield with pre-weathered, durably wettable outer surfaces which have no tendency to coalesce droplets or patches of water and remain uniformly wettable during aging and exposure to the weather.

Yet another object of this invention is to provide a gutter shield which prevents ingress of substantially all particulates, whether falling from above, being blown by wind, or being washed from the roof by rain.

Another object of the present invention is to provide a gutter shield which prevents gutter and downspout overflow during extremely heavy rainfall by valving excess rain away from the gutter.

Another object is to provide a gutter shield which is quickly and easily installed with conventional gutters without special tools, without field adjustment to match roof pitch or trough height, and without excessive lowering of the installed gutter on the fascia board.

Another object of this invention is to provide an easily removable gutter shield which has an easily cleanable surface, resists damage from ladders used to climb to the roof and is easily and compactly stacked for storage and shipping.

BRIEF DESCRIPTION OF THE DRAWINGS

While the specification concludes with claims particularly pointing out and distinctly claiming the subject matter which is regarded as the invention, it is believed that the invention, objects, features, and advantages thereof will be better understood from the following description taken in connection with the accompanying drawings in which like parts are given like indentification numerals and wherein:

BEST MODE FOR CARRYING OUT THE INVENTION

Figure 1:
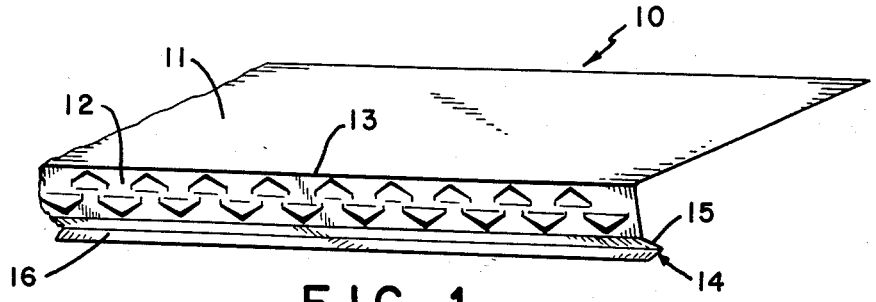
FIG. 1 is a perspective view of the shield of the present invention.

The present invention is an eaves trough/rain gutter shield, indicated generally at 10 of FIG. 1. Shield 10 has a top member 11 which is solid, flat, and when installed is nearly horizontal, but is inclined from horizontal from about 1 degree to about 10 degrees, while the preferred incline is from about 1 degree to about 6 degrees and the most preferred incline is from about 1 degree to about 3 degrees. Side member 12 extends from top member 11 at an angle of from about 90 degrees to about 100 degrees. The preferred angularity is from about 91 degrees to about 96 degrees, while the most preferred angularity is from about 91 degrees to about 93 degrees so that when the shield 10 is installed with top member 11 near horizontal but inclined slightly up and away from side member 12, side member 12 is substantially vertical. Corner 13 is only slightly rounded to prevent exposure of a sharp edge and to promote the bending or rolling of a flat rigid material along corner 13 without significantly reducing the strength of the material. If the shield 10 is extruded or similarly formed without bending, the corner 13 may be substantially square, but should still be slightly rounded to promote uniformity of water flow from top member 11 onto side member 12. While the specific roundness depends in large part upon the material used to form shield 10 and the thickness of shield 10, it is preferred that the round at corner 13 have a radius from about 0.79375 mm (1/32 inch) to about 6.35 mm ($\frac{1}{4}$ inch) while the most preferred radius is from about 1.5875 mm (1/16 inch) to about 3.175 mm ($\frac{1}{8}$ inch).

Figure 2:
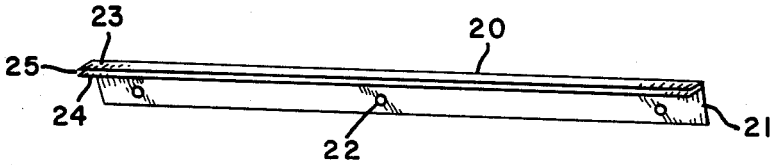
FIG. 2 is a perspective view of the mounting bracket of the present invention.

FIG. 2 illustrates mounting bracket 20 which attaches to the eave of building near the roof. Bracket 20 comprises a flat, elongated base 21 which has mounting apertures 22 inscribed therein for attachment of base 21 to the building in a generally vertical alignment, flush with the building. Lengthwise, the bracket 20 is mounted substantially horizontal, parallel to the gutter of the building. A pair of parallel ridges 23 and 24 extend from the top of bracket 20 at angles of from about 80 degrees to about 90 degrees. The preferred angularity is from about 84 degrees to about 89 degrees, while the most preferred angularity is from about 87 degrees to about 89 degrees. The width of groove 25 between upper ridge 23 and lower ridge 24 is slightly larger than the thickness of the shield 10 to allow the edge of the top member 11 opposite the side member 12 to be inserted therebetween. It is preferred that ridges 23 and 24 extend away from base 21 a distance of about 6.35 mm ($\frac{1}{4}$ inch) to assure containment of the edge of top member 11.

Figure 3:
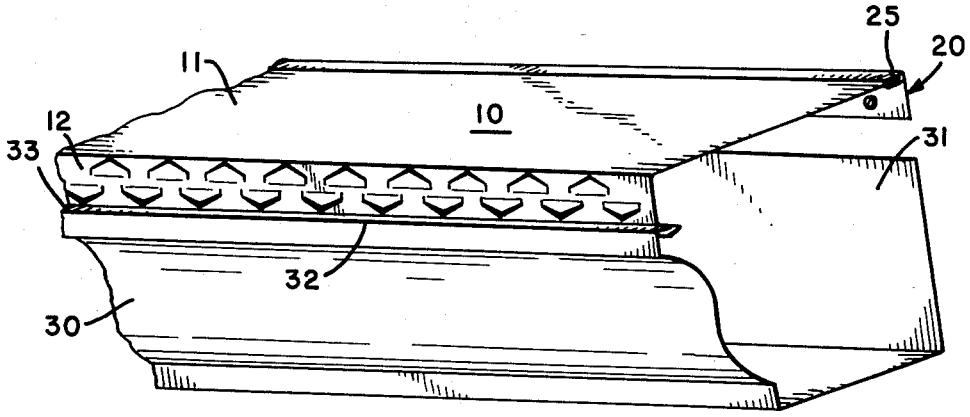
FIG. 3 is a perspective view of the shield and the bracket in cooperation with a conventional rain gutter.

FIG. 3 illustrates the manner in which shield 10 is mounted atop gutter 30 with the assistance of bracket 20. Top member 11 is slightly wider than the width of the longitudinal groove of gutter 30. Beginning with a gutter 30, mounted to the building in a generally horizontal manner, but with sufficient lengthwise incline to promote flow of rain within gutter 30 to appropriate down spouts, bracket 20 is mounted slightly above the inward wall 31 of gutter 30. The elevation of bracket 20 is such that groove 25 is slightly higher than the outer top edge 32 of gutter 30 plus the height of side member 12, thereby providing near horizontal alignment of top member 11 at an incline of from about 1 degree to about 10 degrees from horizontal, with a preferred incline of from about 1 degree to about 6 degrees and a most preferred incline of from about 1 degree to about 3 degrees. A lengthwise flange 33 extends inward and generally horizontal from outer top edge 32 of gutter 30 onto which a lip 14 of FIG. 1 is snapped during installation of shield 10 to secure shield 10. Lip 14 is formed at the bottom of side member 12 by a flange 15 extending inward at an angle of from about 100 degrees to about 115 degrees from side member 12, with a preferred angularity of from about 105 degrees to about 110 degrees. The flange 15 then curves downward and outward along an angle of about 25 degrees to form groove 16 of lip 14 for the insertion of flange 33. The rigidity of shield 10 causes spring pressure between flange 33 and lip 14, thereby holding shield 10 in place as shown in FIG. 3. The outer surface of shield 10 is uniformly wettable in a manner that promotes wettability during weathering and aging of the shield 10. Shield 10 may be formed of metal or rigid plastic. Aluminum and galvanized iron metals are preferred, as are vinyl plastics. While it is known in the art to apply hydrophilic coatings to achieve a desired wettable surface, such hydrophilic coatings deteriorate over time and result in undesired characteristics such as reduction in wettability and non-uniform wettability.

The surface of shield 10, when new, is similar to the naturally aged chalky surface often seen on weathered painted aluminum. Thus, when shield 10 is a painted aluminum product, the wettability of its surface is naturally maintained. Similarly, plastic and unpainted metal shields 10 are made wettable in a manner consistent with natural maintenance of the wettable surface during aging and weathering. Pre-weathering of the shield surface produces a wettable surface in the new, as finished condition which normal weathering will produce over the course of time. Pre-weathering according to this invention is achieved by abrasive buffing of painted and plastic surfaces or by chemical etching of metal surfaces.

The chemical etching process is used only on bare aluminum and galvanized iron surfaces. Alkali and acid compounds are both effective. The preferred etching solution is a dilute solution of hydrochloric acid, from about 30% to about 50% by volume for aluminum and from about 5% to about 10% by volume for galvanized iron. For high speed processing of surfaces, higher concentrations of acid may be used. Special care must be taken to avoid removal of zinc from galvanized surfaces. The etching solution is removed by a water rinse.

Abrasive buffing of painted and plastic surfaces is accomplished by a fine, non-grit, abrasive to achieve a non-slick surface without producing a non-uniform surface. It has been determined that the best abrasive buffing method is achieved with a fibrous scouring pad or cloth of the type available in the form of the familiar maroon pad sold under the trademark Scotch Brite. The scouring pad is preferably mounted on a buffing wheel or roller, and the abrasive buffing method is preferred over the chemical etching method.

Figure 4:
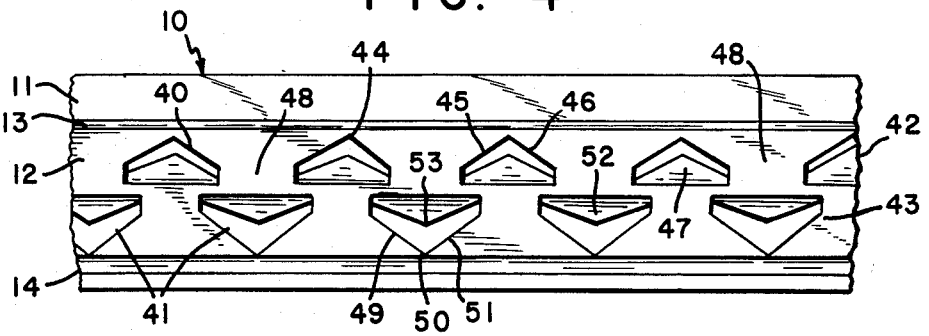
FIG. 4 is a front view of the shield of the present invention.

It is preferred that flat material to be formed into a shield 10 be uniformly pre-weathered before being bent into the top member 11, side member 12 and lip 14 as discussed above. As FIG. 4 illustrates, liquid guidance apertures 40 and liquid receiving apertures 41 are formed in side member 12. A multiplicity of equally spaced apart liquid guidance apertures 40 occupy the upper portion of side member 12 in a substantially horizontal first row 42. A multiplicity of equally spaced apart liquid receiving apertures 41 occupy the lower portion of side member 12 in a substantially horizontal second row 43. Each liquid guidance aperture 40 is generally chevron-shaped, having an upper, central point 44, located slightly below corner 13 a distance of from about 2.38125 mm (3/32 inch) to about 7.9375 mm (5/16 inch) sufficient to be outside the round of corner 13. Left barrier edge 45 extends downward and to the left at an angle of from about 30 degrees to about 40 degrees from horizontal for a distance of about 9.525 mm (⅜ inch) and then extends vertically downward a distance of about 3.175 mm (⅛ inch), and right barrier edge 46 extends downward and to the right at an angle of from about 30 degrees to about 40 degrees from horizontal for a distance of about 9.525 mm (⅜ inch) and then extends vertically downward a distance of about 3.175 mm (⅛ inch). The lowermost point of left barrier edge 45 is the same distance from corner 13 as the lowermost point of right barrier edge 46, and the material between edge 45 and edge 46 is bent along a line between each lowermost point thereof, parallel to corner 13, forming a barrier tab 47. Barrier tab 47 extends inward and upward at an angle of from about 30 degrees to about 45 degrees from the substantially vertical plane of side member 12. Since the surfaces of top member 11 and side member 12 are pre-weathered to a wettable condition, water will evenly disperse thereon in a thin, uniform film and will adhesion flow according to the contour of the surface in a capillary-like action. Since barrier tab 47 and barrier edges 45, 46 abruptly alter the contour of the vertical surface of side member 12, water flowing toward liquid guidance aperture 40 from above will tend to adhere to barrier edges 45 and 46, and will be funneled laterally along barrier edges 45, 46 without reaching the area between the barrier edges 45, 46. Since the barrier tab 47 extends at an angle of at least 30 degrees, water droplets can not bridge from barrier edge 45, 46 to barrier tab 47 even when atmospheric temperature reaches 33 degrees Fahrenheit which normally promotes increased water droplet diameters. The maximum width of liquid guidance aperture 40 is about 15.875 mm (⅝ inch), and its height is about 7.9375 mm (5/16 inch), thereby preventing ingress of any larger particulates. Additionally, since angular extension of barrier tab 47 is no more than 45 degrees, it acts as a physical barrier to ingress of substantially all particulates into gutter 30 through liquid guidance aperture 40. Further, the angularity of edges 45, 46 and tab 47 presents no horizontal edge for collection of particulates, and helps prevent falling, windblow and water driven particles from entering aperture 40. Liquid guidance apertures 40 are uniformly spaced about 12.7 mm (½ inch) from neighboring guidance apertures 40, creating a series of parallel 12.7 mm (½ inch) wide water flow paths 48 between guidance apertures 40, which receive streams of water funneled therefrom.

Figure 5:
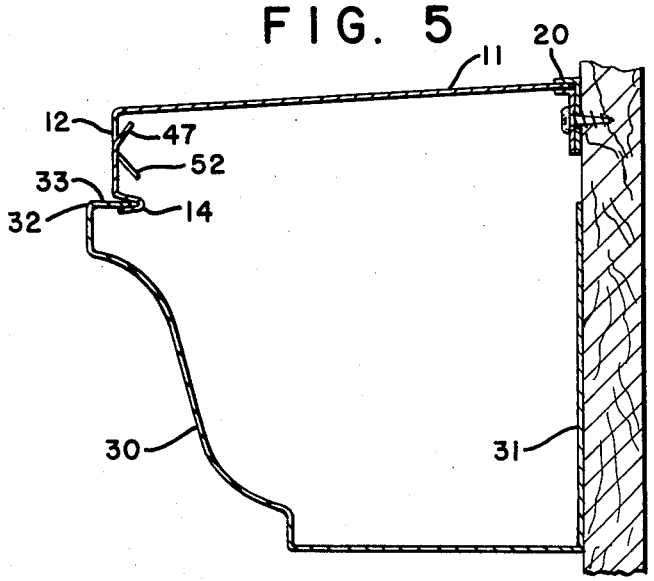
FIG. 5 is a side view of the shield of the present invention.
Figure 6:
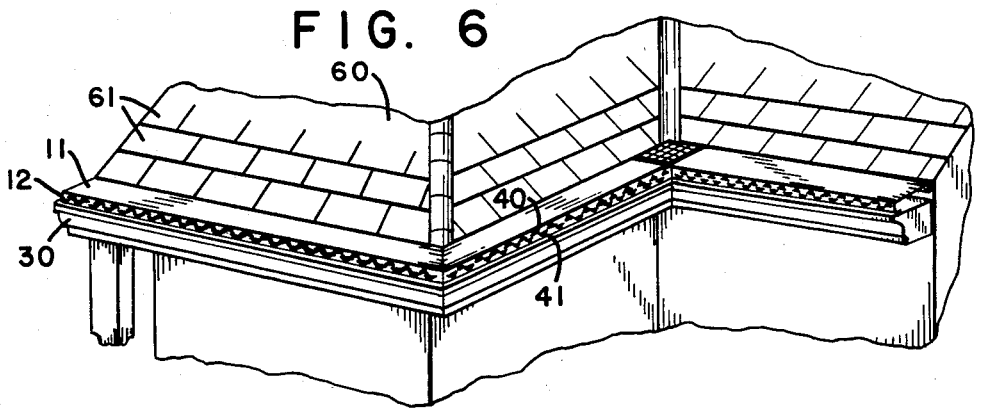
FIG. 6 is an elevation of the present invention as installed on a building.

Directly below each path 48 is a liquid receiving aperture 41, slightly larger than the liquid guidance aperture 40 and having a similar, but inverted chevron-shape. Each receiving aperture 41 is about 19.05 mm (¾ inch) wide and about 9.525 mm (⅜ inch) high. Beginning about 3.175 mm (⅛ inch) to the left and about 1.5875 mm (1/16 inch) below the bottom right corner of a guidance aperture 40 located generally above and to the left of the receiving aperture 41, the left edge 49 of the receiving aperture extends vertically downward a distance of about 3.175 mm (⅛ inch) and then extends downward and to the right at an angle of from about 30 degrees to about 40 degrees from horizontal a distance of about 11.1125 mm (7/16 inch) to a bottom point 50. Beginning about 3.175 mm (⅛ inch) to the right and about 1.5875 mm (1/16 inch) below the bottom left corner of a guidance aperture 40 located generally above and to the right of the receiving aperture 41, the right edge 51 of the receiving aperture 41 extends vertically downward a distance of about 3.175 mm (⅛ inch) and then extends downward and to the left at an angle of from about 30 degrees to about 40 degrees from horizontal a distance of about 11.1125 mm (7/16 inch) to bottom point 50. The material between left edge 49 and right edge 51 is bent along a line between the uppermost point of each edge 49, 51 which is parallel to corner 13, forming a discharge tab 52 therebetween. Discharge tab 52 extends inward and downward at an angle of from about 40 degrees to about 50 degrees from the substantially vertical plane of side member 12. No vertical edge is presented by aperture 41 for the attraction of particulates. Instead, non-horizontal edges 49,51 tend to direct falling and windblown particulates downward, away from aperture 14. As the water travels down path 48 past the bottom corner of the guidance aperture 40 the water flow tends to spread laterally because of the wettable surface of side member 12. However, since the guidance apertures 40 have funneled the stream into a narrow path 48 and receiving aperture 41 is about 3.175 mm (⅛ inch) wider on each side than path 48 and since discharge tab 52 begins its inward contour only about 1.5875 mm (1/16 inch) below the bottom of row 42 of guidance apertures 40, the water flow is drawn along discharge tab 52 to its discharge point 53 where it is coalesced into droplets or a continuous stream of water because of the gradual termination of the wetted surface at discharge point 53. Immediately below receiving aperture bottom point 50, the side member curves inward to form lip 14 as previously discussed. Thus, the height of side member 12 is only from about 19.05 mm (¾ inch) to about 20.6375 mm (13/16 inch), which permits installation of the present invention on a gutter 30 which has a top outer flange 33 as little as from about 20.6375 mm (13/16 inch) to about 25.4 mm (1 inch) below the roof edge. In FIG. 5, the angularity of barrier tab 47, discharge tab 52, and other parts can be more clearly seen. While the aperture 40,41 dimensions may be substantially larger if installation height restrictions are not a factor, the aperture dimensions can not be substantially decreased without promoting undesirable bridging of water from edge 45, 46 to tab 47 and from tab 52 to edge 49, 51. FIG. 6 illustrates the present invention as installed on a building above the eaves trough/gutter 30. Rain flowing down roof 60, across shingles 61 reaches shield top member 11 in a randon flow of streams and droplets, and is uniformly dispersed by the pre-weathered, durably wettable surface of shield 10. The uniform shield of water then travels down top member 11, over corner 13, and begins down the vertical surface of side member 12 where it reaches a first substantially horizontal row of guidance apertures 42 which separates the shield of water into a multiplicity of uniform, parallel, vertical paths funneling to a second substantially horizontal row of receiving apertures 43 which are contoured to direct the water into the gutter 30. Falling and wind blown particulates are prevented from entering apertures 40, 41 because of their relative small size, because their tabs 47, 52 are physical barriers, and because they have no horizontal edges which would tend to collect debris. Particulates such as leaves and pine straw washed from above will tend to bridge apertures 40, 41 and fall to the ground because of their relative rigidity. Because of the relatively sharp corner 13, pine straw in particular, will usually wash to corner 13 and the portion of the straw at corner 13 of will usually stick to shield top member 11 by surface adhesion while the flowing water forces the inner end of the straw to rotate toward corner 13, resulting in the straw being washed over corner 13 in a generally horizontal manner without entering apertures 40, 41. At times, the pine straw will turn generally perpendicular to corner 13, causing a stream of water to flow out the extended pine straw, resulting in an unbalanced state which causes the pine straw to tumble over corner 13 without entering apertures 40, 41. Short or broken pine straw or cedar straw is usually longer than the width of aperture 40, 41, and it is normally trapped in the water film by surface adhesion, and becomes aligned generally parallel to corner 13. It is then also washed over corner 13 without entering apertures 40,41. Because the surface of shield 10 is pre-weathered to a wettable condition, normal aging and weathering maintains its wettable condition. During extremely heavy rainfall, gutter and downspout overflow is reduced by the valving of excess water over barrier edges 45, 46 and between receiving apertures 41 since the force and volume of water will overcome the funneling effect of the barrier edges 45, 46 and permit the water to fall directly to the ground.

Since only about 25.4 mm (one inch) of height is needed to install the present invention, the shield 10 can be installed on some conventional, pre-existing gutters 30 without lowering the gutter on the fascia board. Shield 10 is easily removable for cleaning and maintenance, and its general L-shaped cross section promotes compact stacking thereof which promotes ease of storage and shipping. In addition, since no portion of shield 10 extends past the outer surface of gutter 30, and the shield 10 adds only limited height, the shield is protected by gutter 30 from damage by ladders used to climb to the roof 60.

While this invention has been described in detail with particular reference to a preferred embodiment thereof, it will be understood that variations and modifications can be effective within the spirit and scope of the invention as described hereinbefore and as defined in the appended claims.

INDUSTRIAL APPLICABILITY

This invention is capable of exploitation in the building construction industry and is particularly useful in eaves trough/rain gutter systems.

I claim:

1. An eaves trough/rain gutter shield extending lengthwise to cover a length of rain gutter of the type having a longitudinal groove for the collection of rain comprising:

(a) a flat, solid, near horizontal top member having a width slightly larger than the width of the longitudinal groove of the gutter;

(b) a side member connected to said top member and extending substantially vertically downward to an outer top portion of said gutter, with a multiplicity of liquid guidance apertures and a multiplicity of liquid receiving apertures inscribed therein; wherein said liquid guidance apertures are spaced apart in a substantially horizontal upper row; wherein said liquid receiving apertures are spaced apart in a substantially horizontal lower row; wherein each liquid receiving aperture is located below and between two liquid guidance apertures; wherein all edges of said liquid guidance apertures are non-horizontal; wherein all edges of said liquid receiving apertures are non-horizontal; and wherein said each liquid guidance aperture is generally chevron-shaped, having an upper central point located from about 2.38125 mm (3/32 inch) to about 7.9375 mm (5/16 inch) below the juncture of said top member and said side member, with a left barrier edge extending downward and to the left from said point at an angle of from about 30 degrees to about 40 degrees from horizontal a distance of about 9.525 mm ($\frac{3}{8}$ inch) and then extending vertically downward a distance of about 3.175 mm ($\frac{1}{8}$ inch), with a right barrier edge extending downward and to the right from said point at an angle of from about 30 degrees to about 40 degrees from horizontal a distance of about 9.525 mm ($\frac{3}{8}$ inch) and then extending vertically downward a distance of about 3.175 mm ($\frac{1}{8}$ inch), the material therebetween being bent along a generally horizontal corner extending between the lowermost portions of said barrier edges and extending inward and upward at an angle of from about 30 degrees to about 45 degrees, forming a barrier tab; and (c) attachment means for attaching said top member and side member above said gutter;

further provided that the outer surfaces of said top member and said side member are pre-weathered to durable, uniformly wettable surfaces.

2. The apparatus of claim 1 wherein said near horizontal top member is inclined from horizontal from about 1 degree to about 10 degrees.

3. The apparatus of claim 2 wherein said top member is preferrably inclined from about one degree to about six degrees from horizontal.

4. The apparatus of claim 3 wherein said top member is most preferrably inclined from about one degree to about three degrees from horizontal.

5. The apparatus of claim 1 wherein said side member extends from said top member at an angle of from about 90 degrees to about 100 degrees.

6. The apparatus of claim 5 wherein said side member extends from said top member at a preferred angle of from about 91 degrees to about 96 degrees.

7. The apparatus of claim 6 wherein said side member extends from said top member at a most preferred angle of from about 91 degrees to about 93 degrees.

8. The apparatus of claim 1 wherein said side member extends substantially downward a distance of from about 20.6375 mm (13/16 inch) to about 25.4 mm (1 inch).

9. The apparatus of claim 1 wherein said liquid guidance apertures are spaced about 12.7 mm ($\frac{1}{2}$ inch) apart, forming a multiplicity of water funneling paths therebetween and below.

10. The apparatus of claim 9 wherein a liquid receiving aperture is located in each of said water funneling paths and wherein each liquid receiving aperture has a generally inverted chevron-shape, having a left edge beginning about 3.175 mm (⅛ inch) to the left and about 1.5875 mm (1/16 inch) below a right bottom corner of a first guidance aperture and extending vertically downward a distance of about 3.175 mm (⅛ inch) and then downward and to the right at an angle of from about 30 degrees to about 40 degrees from horizontal a distance of about 11.1125 mm (7/16 inch) to a central bottom point, having a right edge beginning about 3.175 mm (⅛ inch) to the right and about 1.5875 mm (1/16 inch) below a bottom left corner of a second guidance aperture located adjacent to and to the right of said first guidance aperture and extending vertically downward a distance of about 3.175 mm (⅛ inch) and then downward and to the left at an angle of from about 30 degrees to about 40 degrees from horizontal a distance of about 11.1125 mm (7/16 inch) to said central bottom point, with material therebetween bent along a generally horizontal corner extending between the uppermost portions of said edges and extending inward and downward at an angle of from about 40 degrees to about 50 degrees from vertical, forming a discharge tab.

11. The apparatus of claim 1 wherein an outer corner formed by the juncture of said top member and said side member is rounded with a round radius of from about 0.79375 mm (1/32 inch) to about 6.35 mm (¼ inch).

12. The apparatus of claim 11 wherein said round has preferred radius of from about 1.5875 mm (1/16 inch) to about 3.175 mm (⅛ inch).

13. The apparatus of claim 1 wherein said attachment means comprises:

(a) a horizontally elongated bracket attached vertically flush to a building fascia board above said gutter; and (b) a retaining lip formed at the bottom edge of said side member;

further provided that an inward edge of said top member is inserted into said bracket and said retaining lip is snapped onto a lengthwise flange of said gutter which extends inward and generally horizontal from an outer top edge of said gutter, thereby securing said top member and side member above said gutter.

14. The apparatus of claim 13 wherein said bracket comprises a vertical base with a pair of parallel ridges extending from its top a distance of about 6.35 mm (¼ inch) with a groove therebetween having a width slightly larger than the thickness of an edge of said top member opposite said side member for insertion of said edge therein.

15. The apparatus of claim 1 wherein said retaining lip is formed at the bottom of said side member by a flange extending inward at an angle of from about 100 degrees to about 115 degrees from said side member and then curves downward and outward at an angle of about 25 degrees forming a groove therebetween for insertion of an inward extending outer edge of said gutter therein in a snapping manner, thereby providing for retention of said top member and said side member between said bracket and said lip.

16. The apparatus of claim 15 wherein said ridges extend from said base at an angle therefrom of from about 80 degrees to about 90 degrees.

17. The apparatus of claim 16 wherein said ridges extend from said base at a preferred angle of from about 84 degrees to about 89 degrees.

18. The apparatus of claim 17 wherein said ridges extend from said base at a most preferred angle of from about 87 degrees to about 89 degrees.

19. The apparatus of claim 1 wherein said pre-weathered surfaces are abrasively buffed surfaces.

20. The apparatus of claim 1 wherein said pre-weathered surfaces are chemically etched surfaces.

* * * * *